US007862400B2

(12) United States Patent
Discoe et al.

(10) Patent No.: US 7,862,400 B2
(45) Date of Patent: Jan. 4, 2011

(54) TOY VEHICLE

(75) Inventors: Justin Discoe, Fort Collins, CO (US); Joseph T. Moll, Mount Laurel, NJ (US); Kevin Pasko, Hermosa Beach, CA (US); Paulo Kang, Burbank, CA (US); Steven Verbera, Glendora, CA (US)

(73) Assignee: Mattel, Inc., El Segundo, CA (US)

( * ) Notice: Subject to any disclaimer, the term of this patent is extended or adjusted under 35 U.S.C. 154(b) by 114 days.

(21) Appl. No.: 12/109,055

(22) Filed: Apr. 24, 2008
(Under 37 CFR 1.47)

(65) Prior Publication Data

US 2009/0088046 A1 Apr. 2, 2009

Related U.S. Application Data

(63) Continuation of application No. PCT/US2006/043214, filed on Nov. 6, 2006.

(60) Provisional application No. 60/734,011, filed on Nov. 4, 2005.

(51) Int. Cl.
*A63H 17/00* (2006.01)
*A63H 23/00* (2006.01)

(52) U.S. Cl. ..... 446/465; 446/153; 446/154; 446/163; 446/269; 446/431; 446/454

(58) Field of Classification Search ..... 446/153, 446/156, 158, 160, 163, 164, 457, 465, 470
See application file for complete search history.

(56) References Cited

U.S. PATENT DOCUMENTS 3,410,244 A * 11/1968 Graham ..... 440/27
3,418,960 A 12/1968 Herbert (Continued)

FOREIGN PATENT DOCUMENTS

FR 1427230 A 2/1966

(Continued)

OTHER PUBLICATIONS

Office Action Issued Jul. 31, 2009 in CN Application No. 200680041028.3.

(Continued)

*Primary Examiner*—Gene Kim
*Assistant Examiner*—Scott Young
(74) *Attorney, Agent, or Firm*—Panitch Schwarze Belisario & Nadel LLP

(57) ABSTRACT

A toy vehicle includes a plurality of wheels and an electric motor operably coupled to rotate at least one of the wheels. At least the one wheel and preferably each rotated wheel includes a hub and a tire mounted on the hub. The tire has an interior sufficiently hollow to make the wheel buoyant in water and the wheel is sufficiently sealed to prevent water penetration of the interior of the tire with the wheel immersed in water. The tire has a central portion surrounding the hub and a plurality of hollow lobes spaced from one another about the central portion. Each lobe has a pair of opposing outer sides at least one outer side being at least partially inwardly cupped to improve thrust caused by rotation of the wheel in water.

12 Claims, 4 Drawing Sheets

U.S. PATENT DOCUMENTS

| | | | | | |
|---|---|---|---|---|---|
| 3,606,856 | A | * | 9/1971 | Moroga | 440/100 |
| 3,733,739 | A | * | 5/1973 | Terzian | 446/462 |
| 3,891,341 | A | * | 6/1975 | Trainor et al. | 404/121 |
| 4,107,872 | A | * | 8/1978 | Tucker et al. | 446/290 |
| 4,540,376 | A | * | 9/1985 | Turbowitz et al. | 446/164 |
| 4,547,166 | A | * | 10/1985 | Goldfarb et al. | 446/164 |
| 4,652,247 | A | * | 3/1987 | Goldfarb et al. | 446/164 |
| 4,744,781 | A | * | 5/1988 | Ostendorff et al. | 446/164 |
| 4,819,575 | A | * | 4/1989 | Dixon | 440/12.7 |
| 4,902,260 | A | * | 2/1990 | Im | 446/154 |
| 5,426,883 | A | * | 6/1995 | Roberts | 43/43.1 |
| 5,919,075 | A | * | 7/1999 | George et al. | 446/437 |
| 6,264,283 | B1 | * | 7/2001 | Rehkemper et al. | 301/5.1 |
| 6,439,948 | B1 | * | 8/2002 | Ostendorff et al. | 446/154 |
| 6,589,098 | B2 | * | 7/2003 | Lee et al. | 446/465 |
| 6,648,722 | B2 | * | 11/2003 | Lynders et al. | 446/437 |
| 6,966,807 | B2 | * | 11/2005 | Leonov et al. | 440/98 |
| 7,217,170 | B2 | | 5/2007 | Moll et al. | |

FOREIGN PATENT DOCUMENTS

| | | | |
|---|---|---|---|
| FR | 2587675 | A1 | 3/1987 |
| WO | WO-82/02364 | | 7/1982 |
| WO | WO-2005047059 | A2 | 5/2005 |
| WO | WO-2007/056296 | A1 | 5/2007 |

OTHER PUBLICATIONS

European Search Report issued Feb. 25, 2010 in EP Application No. 06827571.8.

* cited by examiner

TOY VEHICLE

CROSS-REFERENCE TO RELATED APPLICATIONS

This patent application claims priority to U.S. Provisional Patent Application No. 60/734,011 filed Nov. 4, 2005, entitled "Toy Vehicle" and is a continuation of International Application No. PCT/US2006/0043214 filed 6 Nov. 2006 with the same title, the disclosures of which are incorporated herein by reference.

BACKGROUND OF THE INVENTION

Toy vehicles are well known. It is believed that a new toy vehicle incorporating a new wheel design capable of operating in multiple environments would provide more engaging play activity than previous toy vehicles.

BRIEF SUMMARY OF THE INVENTION

A toy vehicle comprises a chassis and a plurality of wheels mounted so as to support the chassis; at least one electric motor operably coupled to at least one of the wheels to rotate the at least one coupled wheel about a rotational axis to propel the toy vehicle in a direction at least generally perpendicular to rotational axis and at least one electric power source operably coupled to the motor to power the motor. At least the one wheel operably coupled to the motor includes a hub and a tire mounted on the hub. The tire has an interior sufficiently hollow to make the wheel buoyant in water and the wheel is sufficiently sealed to prevent water penetration of the interior of the tire with the wheel immersed in water and loss of buoyancy. The tire of the at least one wheel has a central portion surrounding the hub and a plurality of hollow lobes spaced from one another about the central portion and extending generally outwardly from the hub, the central portion and the rotational axis. Each lobe is hollow and sealed to water penetration so as to contribute to buoyancy of the wheel. Each lobe has a pair of opposing outer sides cut by a plane perpendicular to rotational axis and bisecting the wheel. At least one of the opposing outer sides of each lobe is at least partially cupped to improve thrust generated by rotation of the at least one wheel in water.

BRIEF DESCRIPTION OF THE SEVERAL VIEWS OF THE DRAWINGS

The following detailed description of the preferred embodiment of the present invention will be better understood when read in conjunction with the appended drawings. For the purposes of illustrating the invention, there is shown in the drawings an embodiment which is presently preferred. It is understood, however, that the invention is not limited to the precise arrangements and instrumentalities shown. In the drawings.

DETAILED DESCRIPTION OF THE INVENTION

Figure 1:
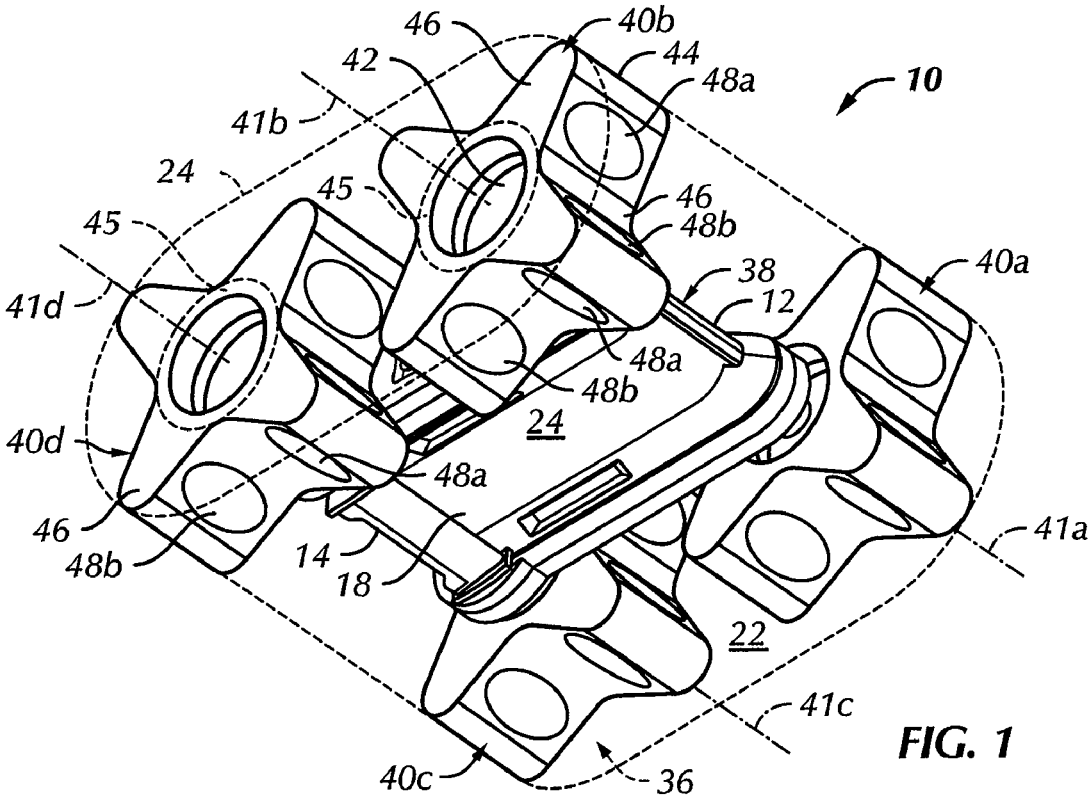
FIG. 1 is an lower perspective view of a toy vehicle in accordance with a preferred embodiment of the present invention.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the toy vehicle and designated parts thereof. The terminology includes the words specifically mentioned, derivatives thereof and words of similar import. Additionally, the word "a" as used in the specification means "at least one."

Figure 2:
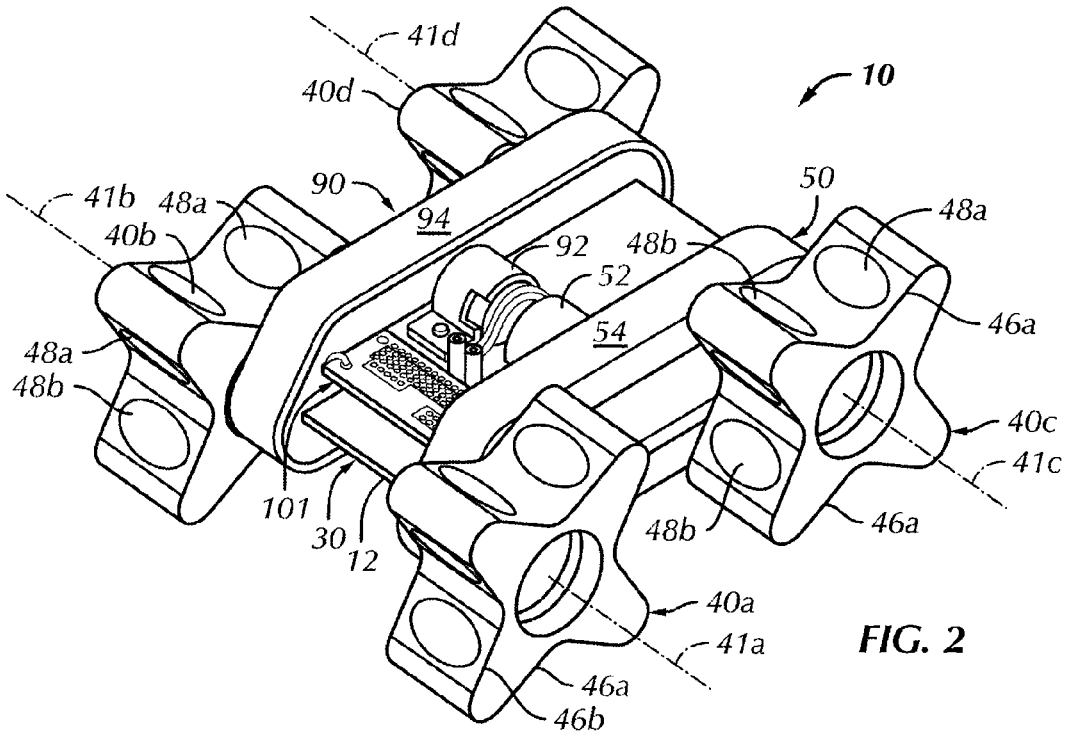
FIG. 2 is an upper perspective view of the toy vehicle of FIG. 1 with the body removed.

Referring to the drawings in detail, wherein like numerals indicate like elements throughout, there is shown in FIGS. 1 and 2 a presently preferred embodiment of a toy vehicle 10. In the figures, toy vehicle 10 includes an exemplary chassis 30, and a plurality of wheels 40 mounted so as to support and propel the chassis 30. Preferably, four wheels 40 are provided: a left front wheel 40*a*, a right front wheel 40*b*, a left rear wheel 40*c*, and a right rear wheel 40*d*. However, it will be appreciated that toy vehicles according to the present invention can have as few as two or three and more than four wheels. Each wheel 40 has a corresponding rotational axis 41, (i.e. 41*a*-41*d*, respectively).

At least one and preferably each of the wheels 40 each include a hub 42 and a tire 44 mounted on the hub 42. Preferably, the hub 42 and tire 44 are separate components, joined together during assembly of the toy vehicle 10. Alternatively, the hub 42 and tire 44 could be formed as a single, unitary component, for example, by coextrusion. Each tire 44 has an interior 44*a* sufficiently hollow to make the wheel 40 buoyant in water. More particularly, referring to FIG. 4, each tire 44 has an outer circumferential surface 147 facing away from the hub 44, the outermost radial parts of which defines a circular circumferential outer perimeter 47 (in phantom), and an opposing circular circumferential inner perimeter 47' defined by a radially innermost part of an inner circumferential surface 147' facing the hub 42. The tire 44 is sufficiently hollow between the outer circumferential surface 147 and the inner circumferential surface 147' and the circular circumferential inner perimeter 47' to make the wheel 40 buoyant in water. The wheel 40 is sufficiently sealed to prevent water penetration of the interior 44*a* of the tire 44 with the wheel 40 immersed in water to cause a loss of the buoyancy. The tires 44 may be made buoyant by having a completely hollow, sealed interior filled with air or other gas or even a vacuum or a partially hollow interior filled, for example, with a foam material 42*c*. The tire 44 may have a solid outer body surrounding a foam filled interior or the foam form the outer surface 44*b* of the tire 44. Preferably, the tires 44 are fabricated from a buoyant material such an expanded plastic material like an expanded polypropylene or another, preferably closed cell foam material and, more preferably, a substantially rigid foam plastic material. Tires 44 made from expanded polypropylene are essentially unpressurized and rigid. The wheels 40 are made sufficiently buoyant from size and material selection and construction to float toy vehicle 10 in water.

Figure 3:
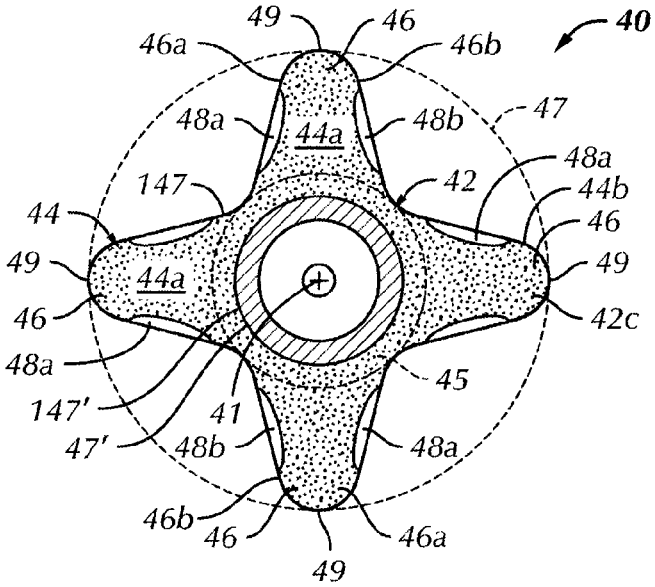
FIG. 3 is a cross-sectional view of one of the vehicle wheels.

Preferably, each tire 44 includes a central portion 45 (in phantom in FIG. 3) and a plurality of arms or lobes 46 spaced apart from one another, preferably uniformly spaced apart from one another about the central portion 45, and extending generally outwardly from the hub 42, the central portion 45 and the rotational axis 41 of the wheel 40. The lobes 46 operate in water like paddles, and allow the toy vehicle 10 to be propelled through water as the wheels 40 rotate. FIG. 3 depicts one of the wheels 40 bisected by a central plane perpendicular to the rotational axis 41 of the wheel. Each of the lobes 46 is hollow and sealed to water penetration so as to contribute to the buoyancy of the wheel 40. Each lobe 46 has a pair of first and second opposing outer sides 46*a*, 46*b* cut by the plane. At least one of the outer sides 46*a* is at least partially cupped, for example, at 48*a* by the provision of a concavity with the same reference number in the outer side 46*a*. The concavity 48*a* improves the thrust generated by the rotation of the at least one wheel in water to improve the propulsion performance of the wheels 40 in water. The opposing outside 46*b* may be similarly cupped at 48*b* by the provision of a similar concavity 48*b* opposite to and a mirror image of the first concavity 48*a*, to improve the reverse propulsion performance of the wheels 40 in water.

Figure 4:
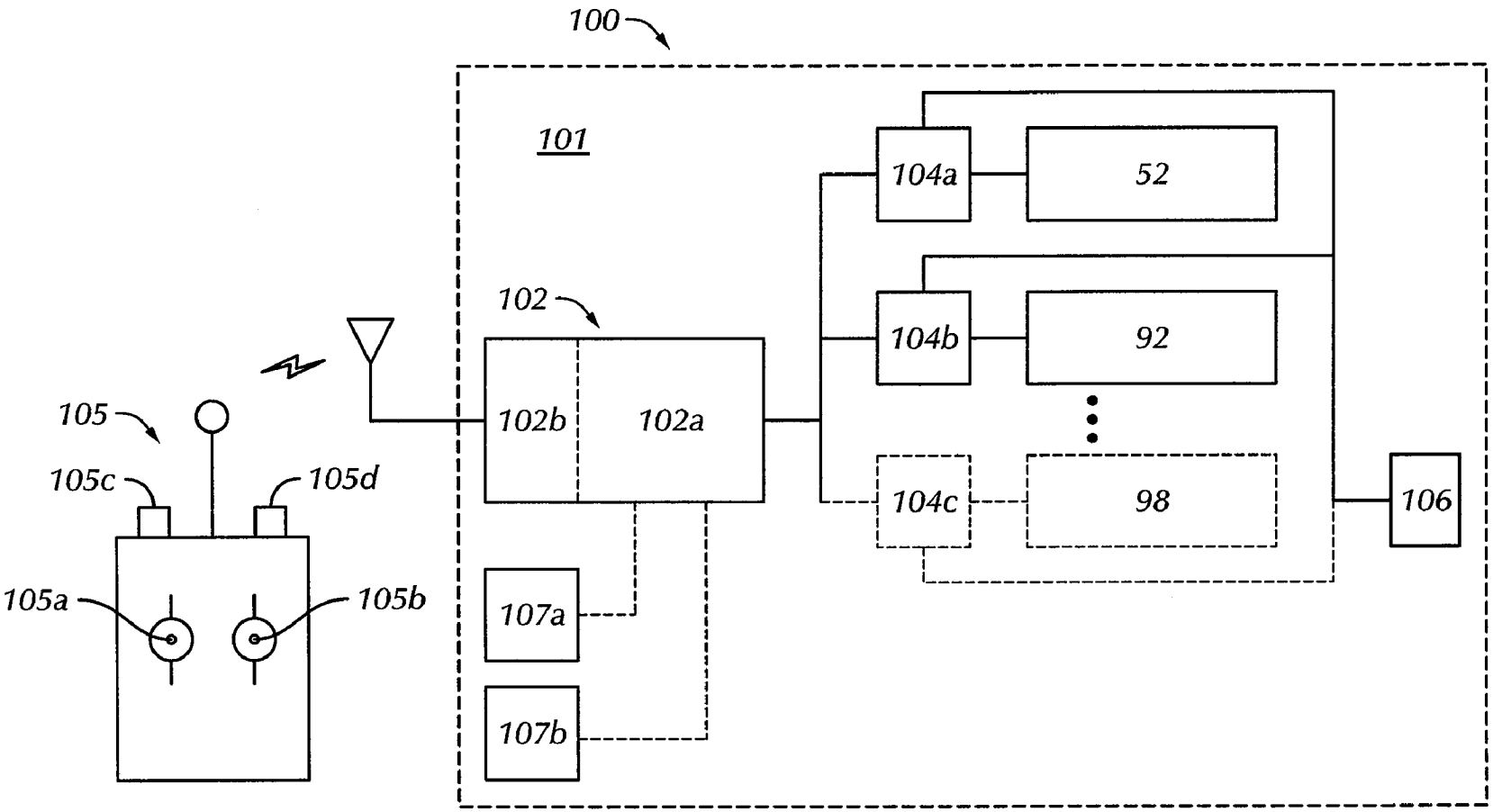
FIG. 4 is a block diagram of the electrical system of the toy vehicle of FIG. 1.

Referring to FIG. 4, the toy vehicle 10 is preferably used in combination with a conventional wireless remote controller 105. The toy vehicle 10 is provided with conventional circuit board 101 (FIG. 2) mounted control circuitry 100 housed in a waterproofed or at least water-resistant housing (not separately shown), and adapted to control operation of a left side drive motor 52 and right side drive motor 92. The circuitry includes an on-board controller 102 with a processor 102*a* plus any necessary related elements such as memory. If the vehicle 10 is wirelessly remotely controlled, it includes a wireless signal receiver 102*b* operably coupled with processor 102*a* and responsive to the remote control transmitter 105. The circuitry might include an accessory motor or actuator 98 (in phantom). The motors 52, 92 and motor/actuator 98 (if provided) are controlled by the processor 102*a* through motor control subcircuits 104*a*, 104*b* and 104*c* (in phantom) which, under control of processor 102*a*, selectively couple each motor and/or actuator 52, 92 and/or 98 with an electric power supply 106 (such as one or more disposable or rechargeable batteries). The toy vehicle 10 is capable of being maneuvered in the manner of a tank by varying the relative direction and/or speeds of rotation of left side drive motor 52 and the left side wheels 40*a*, 40*c* and the right side drive motor 92 and right side wheels 40*b*, 40*d*. The body (not depicted) is preferably sealed to at least resist if not fully prevent water penetration to keep the power supply 106, the control electronics 100, the motors 52, 92 and/or 98 and any other electrical components that may be provided dry with the vehicle operated in water. The body and/or chassis may also include one or more floatation elements (not depicted) to supplement the buoyancy of the wheels 40.

When operated on a solid surface (including concrete, grass, sand, and snow), circumferential outer tips 49 of the lobes 46 sequentially rotate into contact with the solid surface as the toy vehicle 10 moves. The outer tips 49 define an outermost circumferential surface and circumferential outer perimeter 47 (in phantom) of the respective wheel 40. In the depicted embodiment 10, the plurality of wheels 40 are sufficiently large and positioned relative to the remainder 38 of the toy vehicle 10 (constituted by any body and the chassis 30) such that circumferential outer perimeters 47 of the wheels define a volume 36 (in phantom in FIG. 1) fully surrounding and containing the remainder 38 of the toy vehicle 10. In this way, the toy vehicle 10 is operable with either the first side 16 or the second side 18 facing upwards away from a solid surface on which the wheels 40 support the toy vehicle 10. The body 24 may be symmetric with respect to a central plane bisecting all four wheels 40 or have mirror image upper and lower sides or may include a first body style on the first side 16, and a second, different body style on the second side 18. See Lee, et al. U.S. Pat. No. 6,589,098, incorporated by reference herein, for different body styles on opposing major sides of a chassis.

Figure 5:
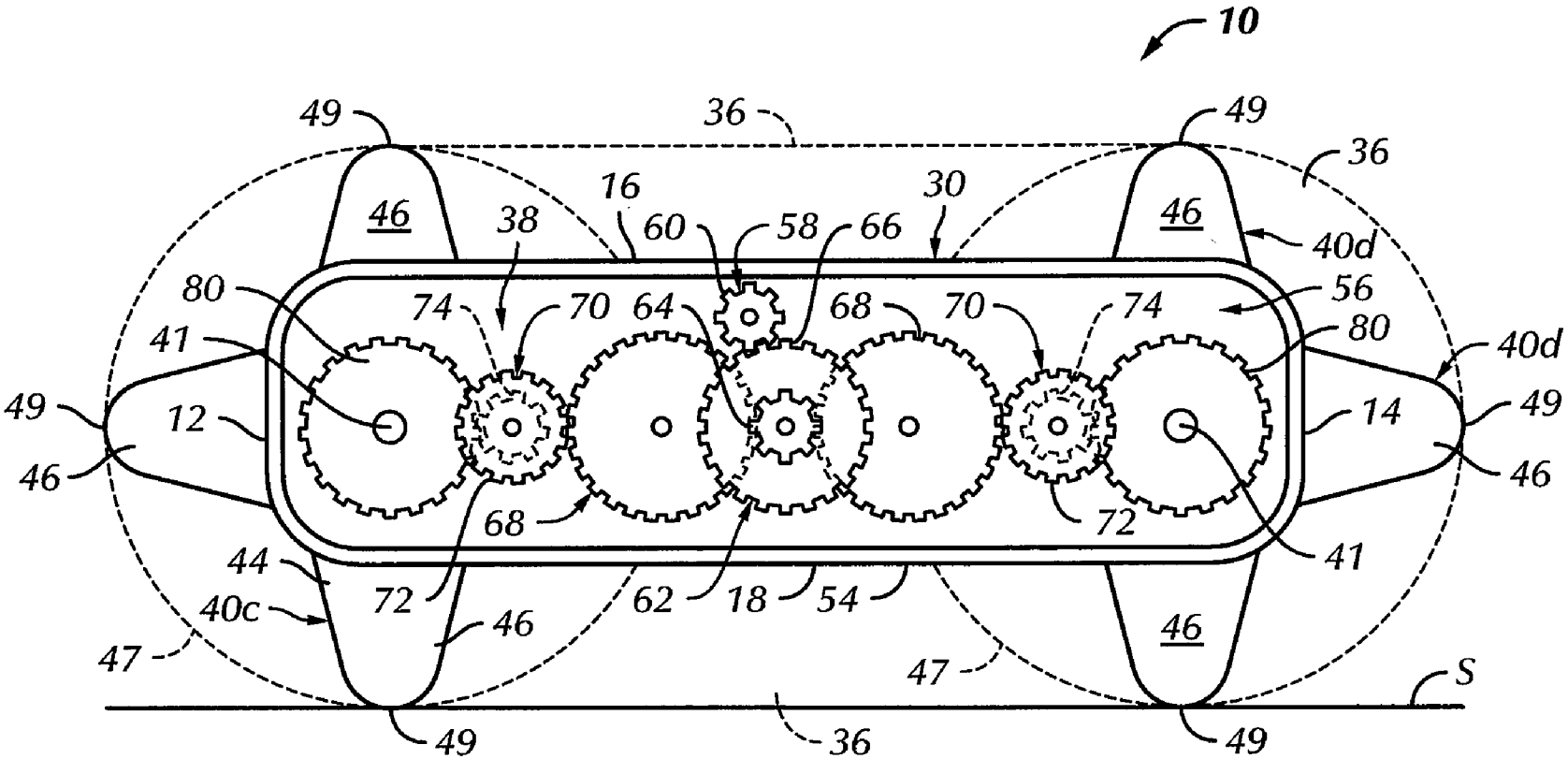
FIG. 5 is an elevation view of an exemplary gear train.

The toy vehicle 10 may be equipped with any of a variety of known wheel drives for propulsion. For example, referring to FIG. 2, the vehicle chassis 30 may include a left side drive indicated generally at 50 and a right side drive indicated generally at 90. The left side drive 50 includes electric motor 52 and drive housing 54 containing a gear train 56, one possible example of which is shown in FIG. 5. Gear train 56 operatively couples the left side drive motor 52 to the left front wheel 40*a* and the left rear wheel 40*c*. Motor 52 includes a drive shaft 58 driving a pinion 60. Pinion 60 drives the larger gear 66 of a first compound reduction gear 62. The second, smaller gear 64 drives a pair of idler gears 68 that drive the larger gears 72 of second compound reduction gears 70. The smaller gears 74 drive output gears 80, which are fixed with the left road wheels 40*a*, 40*c* (omitted in FIG. 5). The right side drive 90 preferably is a mirror image of the left side drive 50 and includes the separately controlled and operated motor 92 driving a mirror image gear train (not depicted) in drive housing 94, which operatively couples the right side drive motor 92 to the right front wheel 40*b* and the right rear wheel 40*d*. The motors 52, 92 are conventional, reversible electric motors of the type known to be used in toy vehicles.

In operation, a user activates the toy 10 and may then proceed to use the manual actuators 105, 105 of the wireless remote controller 105 to control respective independent operation of the left drive motor 52 and the right drive motor 92. By operation of both motors 52, 92, the toy 10 can be propelled forward or backward. By varying the relative speed and/or direction of rotation of the left and right side drive motors, the toy vehicle 10 can be turned while operating either in water or on a solid surface.

It will be appreciated by those skilled in the art that changes could be made to the embodiment described above without departing from the broad inventive concept thereof. For example, the toy vehicle 10 is preferably controlled via radio (wireless) signals from the wireless transmitter 105. However, other types of controllers may be used including other types of wireless controllers (e.g. infrared, ultrasonic and/or voice-activated controllers) and even wired controllers and the like. The vehicle 10 can be constructed of, for example, plastic or any other suitable material such as metal or composite materials. In addition to remote control, the toy vehicle 10 may be operated under programmed control, set during manufacture or selectively by a user or may be configured to proceed in a forward direction and be equipped with suitable sensors/switches (107*a*, 107*b* in phantom in FIG. 4) to respond to contact with obstacles and change direction to avoid the obstacle and proceed forward in a new direction. Also, it is possible to provide a single motor to rotate wheels on both sides of the toy vehicle 10 in a forward direction when the single motor is run in a first direction and geared or clutched or both to turn the toy vehicle 10 when the direction of the motor is reversed. Also, the dimensions of the toy vehicle 10 shown can be varied, for example making components of the toy vehicle smaller or larger relative to the other components. It is understood, therefore, that changes could be made to the preferred embodiment 10 of the toy vehicle described above without departing from the broad inventive concept thereof. It is understood, therefore, that this invention is not limited to the particular embodiment disclosed, but is intended to cover modifications within the spirit and scope of the present application.

What is claimed is:

1. A toy vehicle comprising:

a chassis;

a plurality of wheels mounted to the chassis so as to support and propel the chassis;

at least one electric motor operably coupled to at least one of the wheels to rotate the at least one coupled wheel about a rotational axis to propel the toy vehicle in a direction at least generally perpendicular to the rotational axis; and at least one electric power source operably coupled to the motor to power the motor;

at least the one wheel operably coupled to the motor including a hub and a tire mounted on the hub, the tire having an interior sufficiently hollow to make the wheel buoyant in water and the wheel being sufficiently sealed to prevent water penetration of the interior of the tire with the wheel immersed in water and loss of buoyancy, the tire of the at least one wheel having a central portion surrounding the hub and a plurality of hollow lobes spaced from one another about the central portion and extending generally outwardly from the hub, the central portion and the rotational axis, each lobe being hollow and sealed to water penetration so as to contribute to buoyancy of the wheel, each lobe having a pair of opposing outer sides cut by a plane perpendicular to rotational axis and bisecting the wheel, and at least one of the opposing outer sides of each lobe being at least partially cupped to improve thrust generated by rotation of the at least one wheel in water wherein the at least partial cupping of the at least one of the opposing sides of each lobe is inward and a remaining one of the two opposing sides of each lobe of the tire of the at least one wheel is also at least partially inwardly cupped to improve thrust generated by rotation of the at least one wheel in either rotational direction of the at least one wheel in water, wherein each of the lobes has a height in a radial direction above the central portion of the tire greater than a maximum radius of the central portion of the tire from a center of the tire.

2. The toy vehicle of claim 1 wherein the plurality of lobes of the at least one tire are uniformly spaced apart from one another around the central portion of the tire.

3. The toy vehicle of claim 1 wherein the tire of the at least one wheel being is formed from a closed cell foam material.

4. The toy vehicle of claim 1 wherein the tire of the at least one wheel is formed from an expanded plastic material.

5. The toy vehicle of claim 1 wherein the tire of the at least one wheel is unpressurized and essentially rigid.

6. The toy vehicle of claim 1 wherein the at least one wheel is located on a first lateral side of the toy vehicle and the toy vehicle being further comprising at least another of the plurality of wheels at least essentially identical to the at least one wheel with a hub and a tire with a plurality of lobes extending outwardly from the hub, at least one of two opposing sides of each lobe being at least partially inwardly cupped, the other wheel being located opposite the one wheel on a second lateral side of the vehicle opposite the first lateral side of the vehicle.

7. The toy vehicle of claim 6 further comprising at least a second electric motor drivingly coupled to at least the other wheel to rotate at least the other wheel about an axis parallel to the rotational axis to propel the toy vehicle in a direction at least generally perpendicular to the rotational axis.

8. The toy vehicle of claim 1 wherein each other wheel of the plurality of wheels is at least essentially identical to the at least one wheel with a hub and a tire with a plurality of lobes extending outwardly from the hub, the two opposing sides of each lobe being at least partially inwardly cupped.

9. The toy vehicle of claim 8 wherein outer tips of the lobes of each of the plurality of wheels define a circumferential outer perimeter of each of the wheels and wherein the circumferential outer perimeters of the plurality of wheels define a volume fully surrounding and containing a remainder of the vehicle.

10. The toy vehicle of claim 1 wherein the interior of the tire of the at least one wheel lies between an inner circumferential surface facing the hub and an opposing outer circumferential surface facing away from the hub.

11. The toy vehicle of claim 1 wherein the interior of the tire of the at least one wheel lies between an outer circumferential surface facing away from the hub and an circular circumferential inner perimeter defined by a radially innermost part of an inner circumferential surface facing the hub.

12. The toy vehicle of claim 1 wherein the each lobe has a height in a radial direction above the central portion of the tire more than twice a maximum radial thickness of the tire.

* * * * *